US007456418B1

(12) United States Patent
Stevens et al.

(10) Patent No.: US 7,456,418 B1
(45) Date of Patent: Nov. 25, 2008

(54) RF-ENABLEMENT OF AUDITABLE STORAGE FOR HAZARDOUS MATERIALS

(75) Inventors: John K. Stevens, Stratham, NH (US); Paul Waterhouse, Selkirk (CA); Jason August, Toronto (CA)

(73) Assignee: Visible Assets, Inc, Mississauga, Ontario (CA)

( * ) Notice: Subject to any disclaimer, the term of this patent is extended or adjusted under 35 U.S.C. 154(b) by 345 days.

(21) Appl. No.: 11/164,206

(22) Filed: Nov. 14, 2005

Related U.S. Application Data

(60) Provisional application No. 60/628,001, filed on Nov. 15, 2004.

(51) Int. Cl.
*G21F 5/00* (2006.01)

(52) U.S. Cl. ..... 250/506.1; 588/16; 588/249.5; 588/260; 588/900

(58) Field of Classification Search ..... 250/506.1; 588/16, 249.5, 260, 900
See application file for complete search history.

(56) References Cited

U.S. PATENT DOCUMENTS

| | | | | |
|---|---|---|---|---|
| 4,792,796 | A | 12/1988 | Bradshaw et al. | |
| 4,821,291 | A | 4/1989 | Stevens et al. | |
| 4,879,756 | A | 11/1989 | Stevens et al. | |
| 4,937,586 | A | 6/1990 | Stevens et al. | |
| 5,177,432 | A | 1/1993 | Waterhouse et al. | |
| 5,245,534 | A | 9/1993 | Waterhouse et al. | |
| 5,260,694 | A | 11/1993 | Remahl | |
| 5,374,815 | A | 12/1994 | Waterhouse et al. | |
| 5,532,465 | A | 7/1996 | Waterhouse et al. | |
| 5,905,184 | A * | 5/1999 | Carter, Jr. | 588/260 |
| 6,191,847 | B1 * | 2/2001 | Melendez et al. | 356/73 |
| 6,282,407 | B1 * | 8/2001 | Vega et al. | 455/41.1 |
| 6,617,963 | B1 * | 9/2003 | Watters et al. | 340/10.41 |
| 6,843,135 | B2 * | 1/2005 | Douglas et al. | 73/799 |
| 6,891,470 | B2 * | 5/2005 | Bohinc, Jr. | 340/539.26 |
| 6,981,470 | B2 * | 5/2005 | Bohinc, Jr. | 340/539.26 |
| 7,028,861 | B2 | 4/2006 | Sayers et al. | |
| 7,049,963 | B2 | 5/2006 | Waterhouse et al. | |
| 2002/0154029 | A1 * | 10/2002 | Watters et al. | 340/870.07 |
| 2003/0216607 | A1 * | 11/2003 | Lindgren et al. | 588/258 |
| 2004/0053641 | A1 | 3/2004 | Leung et al. | |

(Continued)

*Primary Examiner*—Jack I. Berman
*Assistant Examiner*—Michael J Logie
(74) *Attorney, Agent, or Firm*—Marina Larson & Associates, LLC

(57) ABSTRACT

A cementitious container that has a low-frequency radio tag containing the container's pedigree and history. The container is used for storage of hazardous waste are disclosed having an inner layer of substantially unhydrated cement in contact with the hazardous waste and an outer layer of hydrated cement. Cementitious hazardous waste containers may be prepared by compressing powdered hydraulic cement around solid hazardous waste materials as well as the encapsulated radio tag that uses low frequency communication. This makes it possible to read and write information though the wall of the container as during transportation to a storage site. Once placed at the storage site, the pedigree, (history contents, Chain of Possession, Proof of delivery, weight), may be checked and verified by reading the tag on a regular basis, (once an hour), to confirm the vessel is intact and has not been moved. Sensors may also be placed on the radio tag to monitor critical parameters like temperature, light levels, movement detectors, and radioactive levels. These may be reported back via the data-link on a regular basis and may also be used as alarms if one moves outside of a specified range.

22 Claims, 9 Drawing Sheets

U.S. PATENT DOCUMENTS

2004/0055391 A1* 3/2004 Douglas et al. ..... 73/779
2004/0069849 A1 4/2004 Stevens et al.
2004/0149822 A1 8/2004 Stevens et al.
2004/0174259 A1* 9/2004 Peel et al. ..... 340/539.26
2004/0205350 A1 10/2004 Waterhouse et al.
2005/0029345 A1 2/2005 Waterhouse et al.
2005/0043850 A1 2/2005 Stevens et al.
2005/0043886 A1 2/2005 Stevens et al.
2005/0083213 A1 4/2005 Stevens et al.
2005/0086983 A1 4/2005 Stevens et al.
2005/0128080 A1* 6/2005 Hall et al. ..... 340/539.26
2005/0149226 A1 7/2005 Stevens et al.
2005/0205817 A1 9/2005 Marcichow et al.
2005/0251330 A1 11/2005 Waterhouse et al.
2006/0124662 A1 6/2006 Reynolds et al.
2006/0128023 A1 6/2006 Waterhouse et al.
2006/0164232 A1 7/2006 Waterhouse et al.
2006/0220857 A1* 10/2006 August et al. ..... 340/572.1
2006/0232417 A1 10/2006 August et al.
2007/0293209 A1* 12/2007 O'Toole et al. ..... 455/419

* cited by examiner

SMART CONTAINMENT VESSEL
ELECTRONIC PEDIGREE

- Produced July 3 2003
- Site La Jolia CA
- Contents Plutonium
- Grade 3.4
- Total 3,443 lbs
- Shipped June 3, 2003
- Stored June 8, 2003
- Lot number 3456789
- Status OK
- Shipper Traker Inc.
- Location 45-6 Tempe AR
- John Jones 456789
- CRC X CRC Y

1101

RF-ENABLEMENT OF AUDITABLE STORAGE FOR HAZARDOUS MATERIALS

CROSS REFERENCES TO RELATED APPLICATIONS

This application claims priority from U.S. application No. 60/628,001, filed Nov. 15, 2004, which application is incorporated herein by reference for all purposes. A related application is U.S. application Ser. No. 10/820,366, filed Apr. 8, 2004, which application is incorporated herein by reference for all purposes.

BACKGROUND OF THE INVENTION

1. Field of the Invention

The present invention generally relates to a containment vessel system and method for handling (e.g., sorting and/or shipping) of toxic wastes, solid radioactive wastes such as plutonium. The invention relates more particularly, to a tracking system and method for audits based on a low frequency electronic radio tag placed within the containment vessel. The present invention relates to what might be called a smart containment vessel for storage of solid hazardous waste materials using the radio tag's memory to store the history and full pedigree of the waste contained in the vessel. More particularly, the present invention is directed to containers prepared from cementitious materials capable of long-term safe storage of certain highly toxic and nuclear waste materials with an embedded low-frequency radio tag that can provide accurate audits and pedigrees of weapons-grade nuclear waste for many hundreds of years.

2. Description of the Related Art

In recent years, the public has become more sensitive to the environment and the effect of hazardous and toxic waste materials on the environmental ecosystem. Nuclear waste materials are some of the most dangerous toxic wastes because they can remain radioactive for extremely long periods of time. There is, therefore, a serious need for effective long-term storage containers for nuclear and other hazardous waste materials.

Much of the nuclear waste materials which need to be disposed of include refuse from nuclear weapons plants, civilian power plants, and medical industry sources. Unlike spent fuel rods which decay by emitting high level gamma radiation, the plutonium waste from weapons plants decays by alpha radiation, which is unable to penetrate paper or clothing. An alpha particle is equivalent to a helium nucleus, having two protons and two neutrons. As a result, the plutonium waste materials from weapons plants may be handled without protective clothing and pose no danger, as long as they remain sealed. Nevertheless, plutonium is extremely toxic and very long-lived. In addition, it is estimated that sixty percent (60%) of the plutonium-contaminated waste from weapons plants is also tainted with hazardous chemicals such as industrial solvents.

Gloves, shoes, uniforms, tools, floor sweepings, and sludge contaminated with radioactive materials while manufacturing nuclear warheads are typically placed in 55-gallon steel drums for containment as hazardous waste items. The Waste Isolation Pilot Project ("WIPP") site near Carlsbad, N.M., is one possible disposal site for such waste materials. The WIPP site was excavated in a massive underground salt formation. Underground salt formations, such as the WIPP site, are considered as possible permanent clear waste disposal sites because of the long-term stability of the underground formation and because salt has a low water permeability.

In one possible disposal plan using underground disposal sites for low-level nuclear waste materials, the underground rooms are filled with the waste containers and back-filled with a grout material to fill as much empty space as possible. During the first 100 years, the underground storage rooms would typically collapse and crush the waste containers.

One problem with conventional 55 gallon steel drums is that eventually, the drums will be crushed when the storage room collapses; however, the presence of empty spaces permits ground water to seep into the cavities which can cause corrosion of the steel drums and decomposition of organic waste materials. Since the disposal site is not completely sealed until the underground storage room collapses and fills all void spaces, rapid collapse of the storage room is desirable so that the disposal site is sealed quickly. Another disadvantage of conventional 55-gallon steel drums is that they are potentially capable of undergoing corrosion which would produce gases, especially $H_2$.

An ideal solid hazardous waste container should satisfy some of the following desired characteristics:

(1) The container should be made of a nonmetal or other material which intrinsically does not corrode and produce gases;

(2) The container should be inexpensive;

(3) The container should be impermeable to water and, if water does penetrate the container, it should act as an $H_2O$ "getter", i.e., it should combine with water to form an insoluble solid;

(4) The container should have $CO_2$ "getter" characteristics, i.e., it should react with $CO_2$ to form a solid; and (5) The container should be of a material which expands if, for any reason, an aqueous solution does breach the impermeable outer layer. Expansion of the material on contact with water seals and fills any cracks in the container wall, and also fills any space between the storage container and the walls of the salt mine which collapse around the container. Such containers have been disclosed and described in U.S. Pat. No. 5,100,586 (issued to Jennings, et al. on Mar. 31, 1992), and U.S. Pat. No. 5,543,186 (issued to Andersen, et al. on Aug. 6, 1996). A sixth requirement is:

(6) The container should have a tamper-proof system capable of providing adequate information on the container contents and history. Such a system should be able to be read remotely without opening the container, and ideally while the container is buried. For example, it would be helpful to have a secure electronic pedigree that can be tracked and traced for a minimum of 50 years—preferably remotely by using a radio tag or other electronic system.

An additional major problem is that once waste materials have been placed inside the drums or other containment vessels, they often must be tracked and traced with a strong audit trail from the site where the waste material is placed inside the drum. This is particularly true for weapons-grade nuclear waste (e.g. plutonium) that often is processed in plants in Europe or at other distant locations. This information about the vessel's history, its full contents, chain of passage (COP), and proof of delivery (POD) must be stored and made available to prove that weapons-grade waste materials have not been diverted and the nuclear waste stored in containment vessels is fully intact. One may refer to this as the "Container Pedigree".

Attempts to use RF-tags or radio tags that use frequencies over 1 MHz attached to the outside of the container as an ID, have proven unreliable for several reasons. In the case of 55 gallon drum containers, the metal can lead to reflections. In the case of the non-metal cementitious containers, the cement itself can block and absorb radio waves, particularly if the outside surface becomes wet, or as is often the case, is surrounded by damp soil.

Most of the commercial RF-tags are transponder devices that receive power from a carrier signal. These have no batteries and are known as "passive tags". Passive tags have the advantage of no battery, but the disadvantage that they only provide for a weak return signal that is not capable of working reliably in any harsh environment since the carrier power transfer drops off very rapidly with distance. "Active tags", on the other hand, use batteries that make the tag work as an amplified transponder. However because they use high frequencies they have a typical battery life of only a few years. In addition, if they work at frequencies above 1 MHz, active RF-tags will also have difficulty in harsh environments comprising steel or earth (just as would the passive tags), especially earth with moisture in the soil.

Moreover, in most cases the requirement for any data storage for the container pedigree will be a minimum of 50 years up to 200 years and the information must be read from great distances, (30 feet or more), from the surface and through a thickness of many feet of salt, sand, and soil, since the containers will often be buried underground.

An additional problem with conventional active and passive radio tags, (RF-tags or "RFID" tags), is that they must be attached to the outside of the waste container so they have a major disadvantage in that they may be removed and/or easily altered. However, if instead they were placed inside the waste container, their signal would be blocked by the intervening steel drum and soil, and thus it would be impossible to read the information from the RF-tag.

Finally, most of the active and passive radio tags may have a fixed ID that is programmed at the factory. This requires an external database containing that ID together with corresponding information associated with the vessel. The cost of maintaining a remote, secure, reliable, independent database for the container's pedigree based on a fixed ID's information, especially for hundreds of years, is prohibitively difficult.

SUMMARY OF THE INVENTION

The present invention broadly provides a container for storing a hazardous waste item, (e.g. steel drum holding plutonium or other nuclear waste material), said container comprising:

a) an RFID tag comprising an antenna, a transceiver operable at a low radio frequency not exceeding 15 MHz, a data storage device, a microprocessor operable to control data flow between the aforesaid data storage device and the aforesaid transceiver, and an energy source for providing energy to the aforesaid transceiver, the aforesaid data storage device, and the aforesaid microprocessor;

b) An encasement structure surrounding the aforesaid waste item and the aforesaid RFID tag, the aforesaid encasement structure comprising a cementitious composition.

According to a preferred embodiment, the aforesaid container comprises:

a) an inner layer surrounding the aforesaid waste item, the aforesaid inner layer comprising an unhydrated cementitious composition;

b) an RFID tag comprising an antenna, a transceiver operable at a low radio frequency not exceeding 15 MHz, a data storage device, a microprocessor operable to control data flow between the aforesaid data storage device, the aforesaid transceiver, and an energy source for providing energy to the aforesaid transceiver, the aforesaid data storage device, and the aforesaid microprocessor;

c) An outer layer surrounding the aforesaid inner layer and the aforesaid RFID tag, the aforesaid outer layer comprising a hydrated cementitious composition.

Preferably, the aforesaid low radio frequency does not exceed 1 MHz and may, for example, be 128 KHz.

For the reasons discussed hereinabove, it is preferred that the aforesaid data storage device be operable to store information selected from data for identifying the aforesaid container, pedigree data, (e.g., historical, COP, POD data), about the aforesaid container, and pedigree data about the aforesaid steel drum or other waste item.

The aforesaid energy source may preferably comprise an energy storage device, such as a long life battery.

Moreover, the aforesaid energy source may comprise a tag coil in the RF-tag which is operable for energization thereof, as a result of inductive coupling of the aforesaid tag coil to an external coil. Also, the aforesaid energy source may further comprise an energy storage device, (e.g., a high capacity battery), and an AC-to-DC converter, (e.g., rectifier), operable to charge the aforesaid energy storage device from AC energy induced in the tag coil.

Since a large loop antenna affords stronger signal reception, the aforesaid antenna preferably comprises a loop antenna characterized by dimensions comparable to the large dimensions of the aforesaid multi-gallon steel drum or other waste item.

For protection against chemical action and the like, the aforesaid RFID tag may be encased in a protective shell, (e.g., matrix of epoxy and carbon fibers), before the aforesaid disposing step c).

Preferably, the aforesaid RFID tag comprises a condition sensor operable to sense a condition experienced by the aforesaid RFID tag, (e.g., temperature, radiation level, humidity, GPS location), the aforesaid condition sensor being operable for communication, with the aforesaid microprocessor for storage in the aforesaid data storage device, of data that defines the aforesaid condition.

According to a preferred embodiment, the aforesaid container further comprises an indicator device operable to emit a signal at the aforesaid low radio frequency upon detecting an aforesaid condition that is beyond a selected threshold level.

The invention also broadly provides a system for accessing information about a hazardous waste item during shipment and storage thereof, the aforesaid system comprising:

1) A container for storing the aforesaid hazardous waste item, (e.g., steel drum holding plutonium or other nuclear waste material), the aforesaid container comprising:

a) an RFID tag comprising an antenna, a transceiver operable at a low radio frequency not exceeding 15 MHz, a data storage device, a microprocessor operable to control data flow between the aforesaid data storage device and the aforesaid transceiver, and an energy source for providing energy to the aforesaid transceiver, the aforesaid data storage device, and the aforesaid microprocessor;

b) an encasement structure surrounding the aforesaid waste item and the aforesaid RFID tag, the aforesaid encasement structure comprising a cementitious composition; and 2) A field antenna operable to send an interrogation signal to the aforesaid RFID tag at the aforesaid low radio frequency and to receive data signals at the aforesaid low frequency from said RFID tag.

Preferably, the aforesaid system further comprises a WOW, (write-once-only), data storage device, (e.g., a PROM or an unalterable CD), the aforesaid WOW data storage apparatus being in communication with the aforesaid field antenna and operable to store, in an unalterable manner, the aforesaid data signals from the aforesaid RFID tag.

The invention also broadly provides a method for accessing information about a hazardous waste item during shipment and storage thereof, the aforesaid method comprising:

1) Surrounding the aforesaid waste item and an RFID tag in a container, the aforesaid container comprising a cementitious composition as disclosed hereinabove, the aforesaid RFID tag comprising a tag antenna, a transceiver operable at a low radio frequency not exceeding 15 MHz, a data storage device, a microprocessor operable to control data flow between the aforesaid data storage device and the aforesaid transceiver, and an energy source for providing energy to the aforesaid transceiver, the aforesaid data storage device, and the aforesaid microprocessor;

b) An encasement structure surrounding the aforesaid waste item and the aforesaid RFID tag, the aforesaid encasement structure comprising a cementitious composition;

2) Disposing a field antenna, (e.g., a loop antenna with a 50-foot diameter), in spaced adjacency to the aforesaid container, (e.g., on the surface of the ground above a storage facility containing many waste-containing steel drums);

3) Receiving data signals, (e.g., representing a condition experienced by the aforesaid RFID tag), of the aforesaid low radio frequency, at the aforesaid field antenna and transmitting them to computing device, (e.g., server);

4) Storing information based upon the aforesaid data signals, in a data storage apparatus, (e.g., an unalterable CD).

Preferably, the aforesaid RFID tag comprises a condition sensor operable to sense a condition experienced by the aforesaid RFID tag, (e.g., temperature, radiation level, humidity, GPS location), the aforesaid condition sensor being operable for communication with the aforesaid microprocessor for storage, in the aforesaid data storage device, of data that defines the aforesaid condition, the aforesaid receiving step 3) further comprising the steps of interrogating the aforesaid RFID tag with an aforesaid low radio frequency interrogation signal to obtain the aforesaid data signals representing the aforesaid data that defines the aforesaid condition.

Preferably, the novel method further comprises the step of safeguarding the aforesaid data storage apparatus, (e.g., disposing the aforesaid data storage apparatus at a remote location that is under the control of trustable security conditions, such as government personnel with appropriate security clearances).

The invention also broadly provides a method for containing a hazardous waste item, the aforesaid method comprising the steps of:

a) Disposing an inner layer of powdered hydraulic cement around a waste item, (e.g., a bulk quantity of solid hazardous waste, such as a multi-gallon steel drum filled with nuclear waste material);

b) Compressing the aforesaid inner layer of powdered hydraulic cement around the aforesaid waste item, (e.g., at a pressure in the range from about 100 psi to about 100,000 psi), to form a compressed inner layer;

c) Disposing, adjacent the aforesaid compressed inner layer, an RFID tag comprising an antenna, a transceiver operable at a low radio frequency not exceeding 15 MHz, (e.g., 128 KHz), a data storage device, a microprocessor operable to control data flow between the aforesaid data storage device and the aforesaid transceiver, and an energy source for providing energy to the aforesaid transceiver, the aforesaid data storage device, and the aforesaid microprocessor;

d) Positioning an outer layer of cement paste around the aforesaid compressed inner layer of powdered hydraulic cement; and e) Hydrating and curing the aforesaid outer layer of cement paste without substantial hydration of the aforesaid compressed inner layer of powdered hydraulic cement.

Preferably, the aforesaid RFID tag is encased in a protective shell, (e.g., matrix of epoxy and carbon fibers), before the aforesaid disposing step c).

According to a preferred embodiment, the aforesaid disposing step c) further comprises a step of disposing a loop antenna adjacent the aforesaid compressed inner layer, the aforesaid loop antenna being operable for communication with the aforesaid transceiver, the aforesaid loop antenna preferably having dimensions that are substantially comparable to the aforesaid waste item.

The present invention is directed to novel containers similar to that described in U.S. Pat. Nos. 5,100,586 and 5,543,186, (which are incorporated herein by reference), for storage of solid waste materials such as highly toxic, and nuclear waste materials that have an embedded low frequency, (1 MHz), radio tag. Preferably, the present invention includes cementitious containers having a hydrated outer shell to provide mechanical strength and an unhydrated compressed inner layer in contact with the waste materials which is capable of reacting with any aqueous solution which may penetrate the outer shell or leak from the contained waste material. The radio tag is held within the unhydrated compressed inner layer together with the waste material itself and uses low frequency inductive communication to transmit data signals through the outer layer and through solid sand and other materials. It also uses low frequency inductive links, (under 1 MHz), to transmit data and power to the radio tag after the battery has stopped working, (15-35 years), so the radio tag may be read beyond the 50-year time requirement.

The major challenge is that for the radio tag to be secure and tamper proof it must be placed inside the containment vessel and be capable of communication through the sealed walls of the vessel. That eliminates possibility of any direct wired connection though the walls of the containment vessel. Therefore, for optimal communication and power, both for data transfer and to obtain power from external power sources, the RF-tag must be wirelessly linked though the containment vessel's outside wall. This requirement means if the tag is used in a cement based container it must withstand pressures of 30,000 lbs/sq inch when the waste and materials are compressed. It also means the data radio signals must be able to penetrate the cement shell even if the outside material is moist or wet.

The advantage of using low frequency inductive communication, (10 KHz up to 1 MHz), over conventional high frequency radio signals are many. Since the energy is essentially all in near-field, (i.e., magnetic or inductive), it can easily penetrate water and moisture, and water has no effect on the near-field signal strength. Steel and metal can distort the near-field signal, but it does not block or reflect it unless the low frequency radio tag is contained inside of a 100% sealed Faraday cage. We have devised a radio tag that works in the preferred embodiment, low frequency of 128 KHz, and uses a loop antenna. At these low frequencies in the near-field, the signal strength increases directly with the total area of the antenna as well as the total number of turns of the loop, (total effective cross-sectional area). This is not true with systems based on far-field signals that require an optimal ¼-wave length antenna, (see U.S. Provisional application 60/589,524). Thus, since these containment vessels may be large, (e.g., 24 inches by 24 inches), we are able to use a large area antenna inside the vessel, thereby providing a significantly enhanced signal-to-noise ratio.

In addition, the radio tag may have sensors that may be used to measure temperature, light levels, (to prove container is sealed), jog and/or movement, (to prove that container is stationary), and radiation levels. This information may be written to a log in the radio tag's memory or may simply be reported on a regular basis when the radio tag is checked. It may also be used to trigger alarms when any parameter moves outside of a specified range, so the radio tag can transmit a signal indicating a problem, (see U.S. Provisional application 60/515,074, "Auditable Authentication of Event Histories for Shipped and Stored Objects"; and U.S. Provisional application 60/461,562, "Networked RF-Tag for Tracking Freight").

An additional advantage of low-frequency is that since the radio circuitry also operates at a very low frequency, power consumption is extremely low and battery life is maximized. In practice, the operating life approaches the shelf-life of the battery. Standard Li batteries have a minimum shelf life of 15 years, and in some cases may be a maximum of 35 years. However, to achieve a long-life tag, (readable over 50 years), will require an additional auxiliary power source external to the vessel. In the preferred embodiment, the secondary power source may be placed externally on the surface of the vessel so it can transfer power to a separate matched coil several inches away, located inside the container. Another advantage is the capability of placing the radio tag into/inside the wall of the container during the forming process and then immediately giving structural integrity to the container so that it is fully identified and secure in a single step. This system is improved over use of a distant carrier now used in passive tags since it transmits maximum power to the radio tag. This external "Power Pod" can also be optionally used to read and write information to the tag and can display data on a small display that is specific to that drum or container, (e.g., the serial number of the drum or container), and optional LEDs can be used for sorts, picks and puts of the vessel as it is being transported. Even if the Power Pod is accidentally or intentionally removed, it will have no effect on the integrity of the data or container pedigree even if it occurs after the radio tag's internal battery dies. This is simply because the data will always be maintained in the radio tag contained inside the vessel and the external devices simply read that information. Many of the featured advantages of having a display and LED attached to the container are disclosed in U.S. Provisional applications: 60/378,230, 60/359,350, 60/461,562, and 60/589,524.

Finally, the radio tag may be encapsulated in a non-compressible material that cures in a mold, (e.g., epoxy). Materials that use epoxy with carbon fibers are capable of withstanding 50,000 lbs/sq inch so that the radio tag, once encapsulated, may survive the compression required to be placed inside the container.

The concept of storing the full pedigree inside the container itself may make unnecessary the use of remote, external databases, (which must then be maintained remotely for many years). According to the present invention, the database is part of the container so it may be accessed directly via a reader. As the pedigree is read remotely and transmitted to a central location, the data, along with the date and time, may be written to a RO-CD with a timing track to provide an optional full audit trail. Once the container has been placed at its final location, the audit trail may not be required.

DESCRIPTION OF THE FIGURES

Smart Containment Vessel

FIG. One: Overview of the smart containment vessel, item numbers 1, 2, 3 represent a low frequency inductive radio frequency (RF) tag based on technology similar to that described in the references cited hereinbefore. The tag consists of an optional power loop 1, which can be used to power the tag using an external power pod 2, the actual circuitry used to store data, a RF modem and processor, and a loop antenna 3, for two way data communications. These three components, (1, 2, 3), may be placed into a mold 4, that can be filled and sealed using epoxy that has been strengthened with carbon fibers or other the like so that the tag may withstand the high pressures required to fabricate the container. The entire tag assembly, (1, 2, 3 and 4), will be placed inside the containment vessel 5, when it is fabricated. The "smart" containment vessel 5, is based on cementitious storage containers having an inner layer of substantially unhydrated cement in direct contact with hazardous waste material, (such as plutonium), and an outer layer of fully hydrated hardened cement. The RF-tag, once encapsulated in the epoxy and in the unhydrated cement, may communicate through the cement via ultra low frequency, (e.g., 128 KHz), inductive energy using the loop antenna 3.

Figure 1:
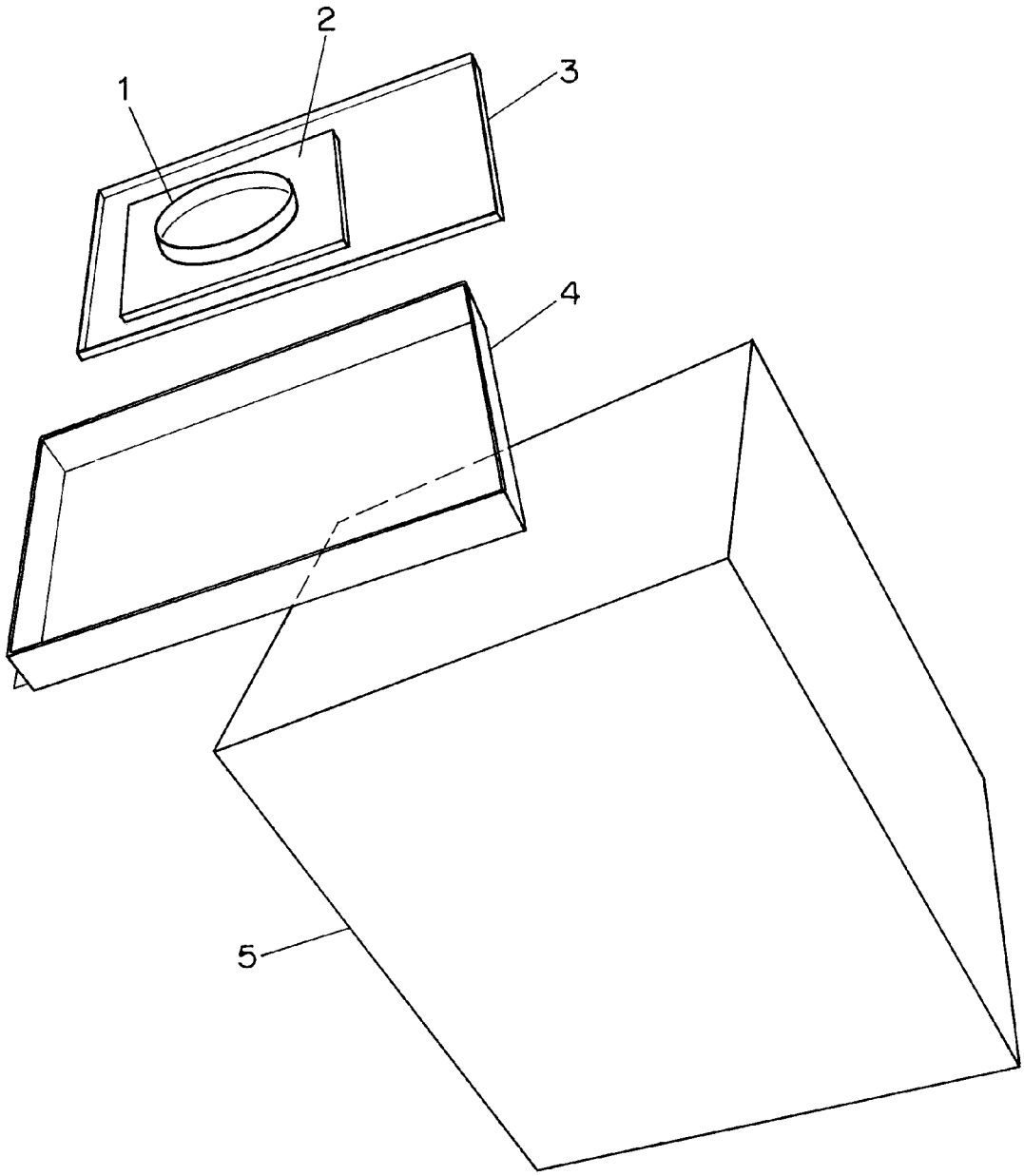
Figure 2:
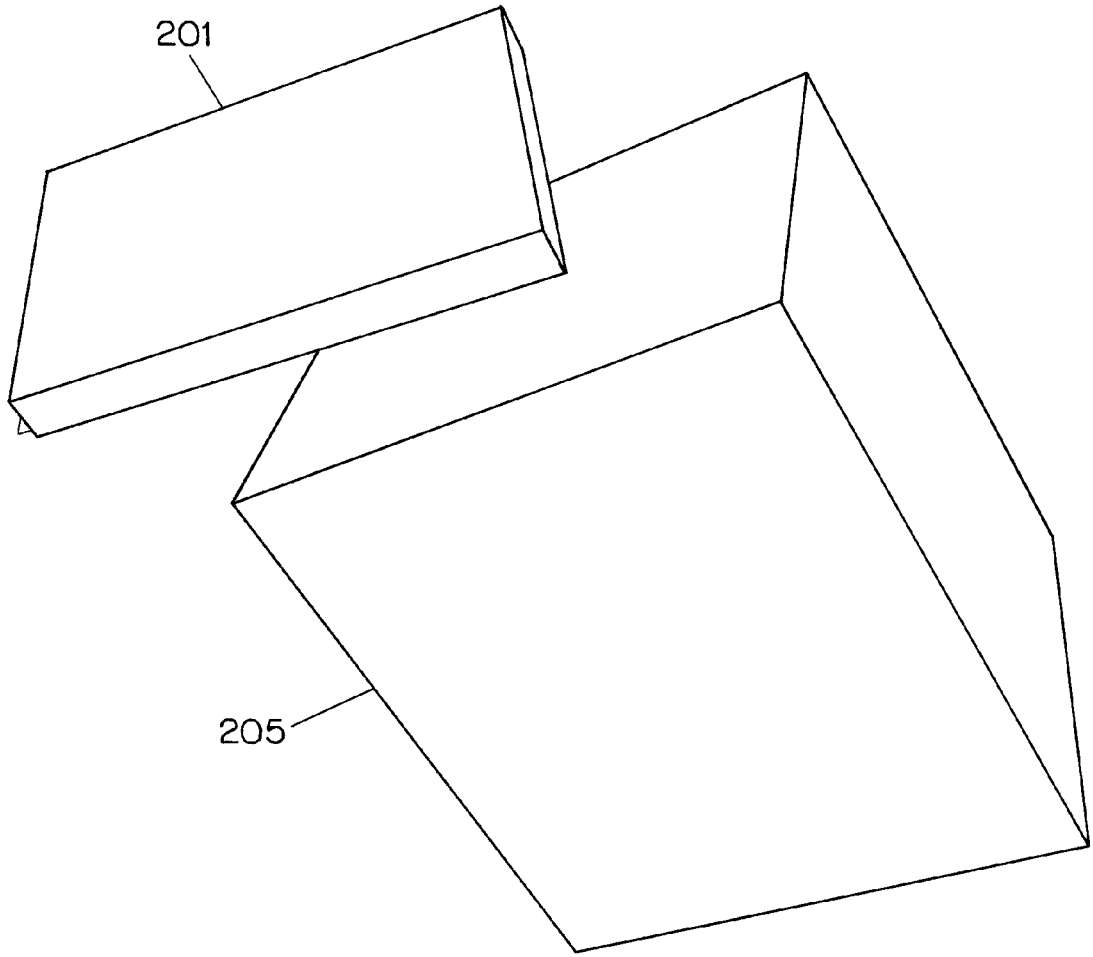
Figure 3:
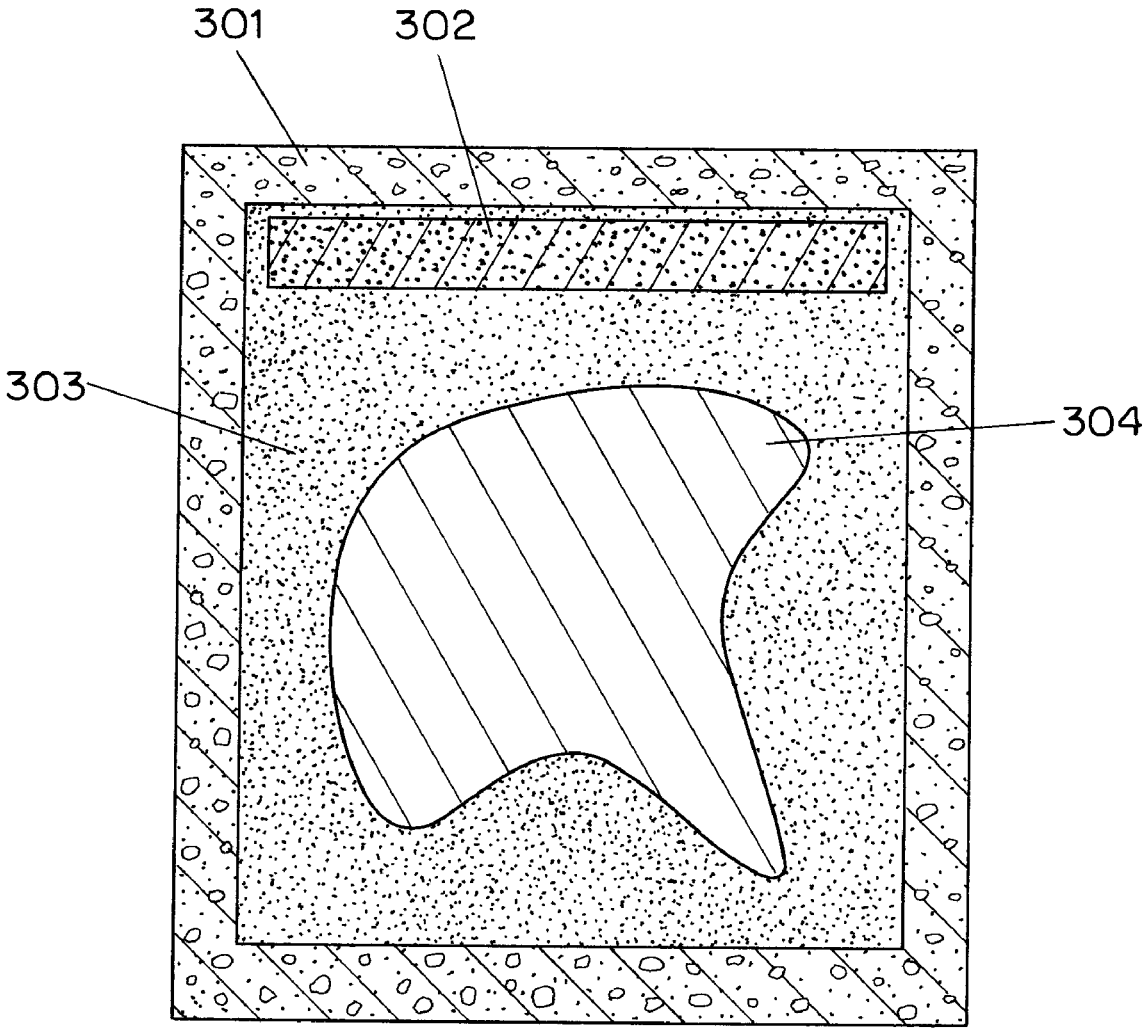

FIG. Two: Item number 201 shows the encapsulated RF-tag with a finished containment vessel, item number 205. The tag has an outside dimension slightly smaller than the containment vessel, with a loop antenna that has a maximum dimension within the unhydrated cement. The larger the antenna, the greater the signal-to-noise ratio and communication between the reader and the tag improves.

FIG. Three: A cross-sectional view of a finished smart containment vessel. Item number 301 is the hydrated cement outer casing, item number 302 is the potted radio tag held within the unhydrated core region 303 of the vessel, and item number 304 is the radioactive waste material.

Figure 5:
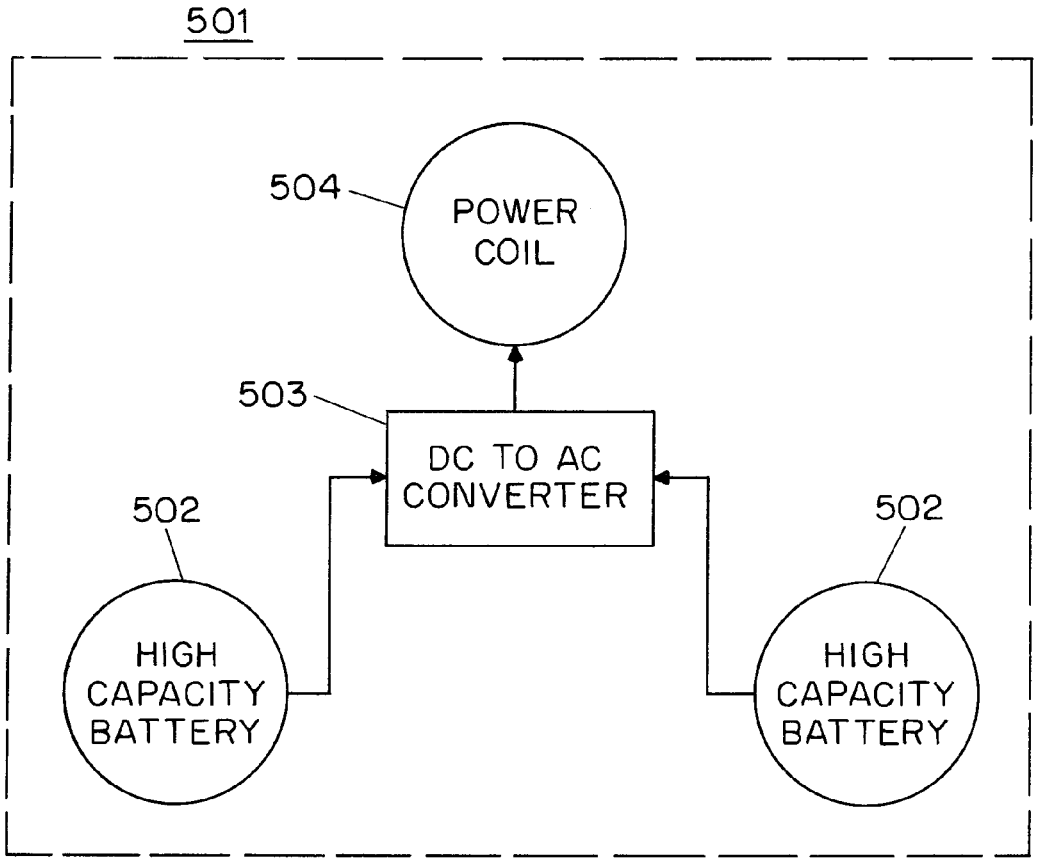
Figure 6:
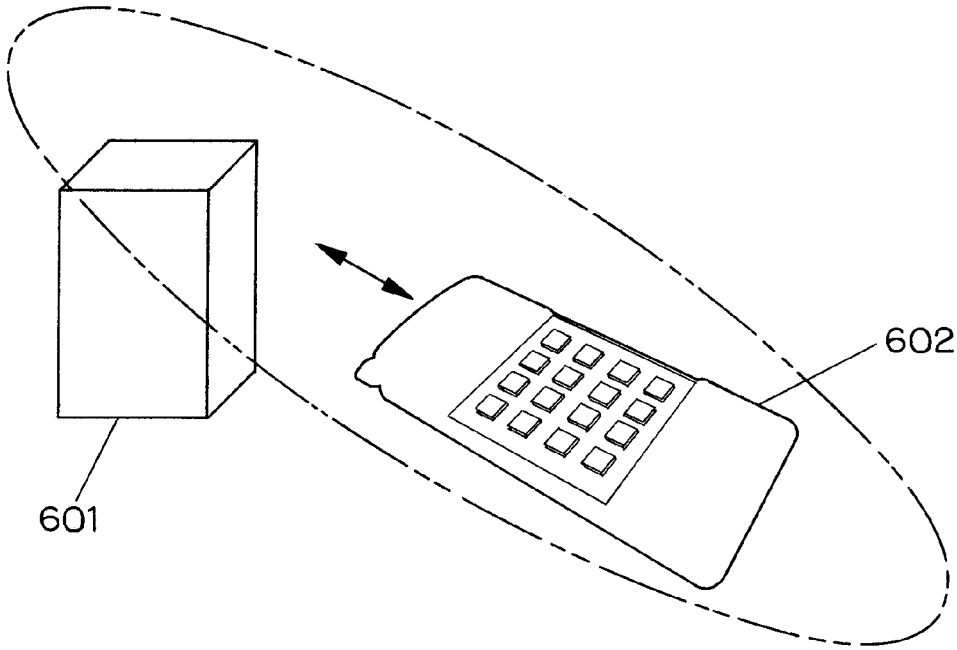
Figure 7:
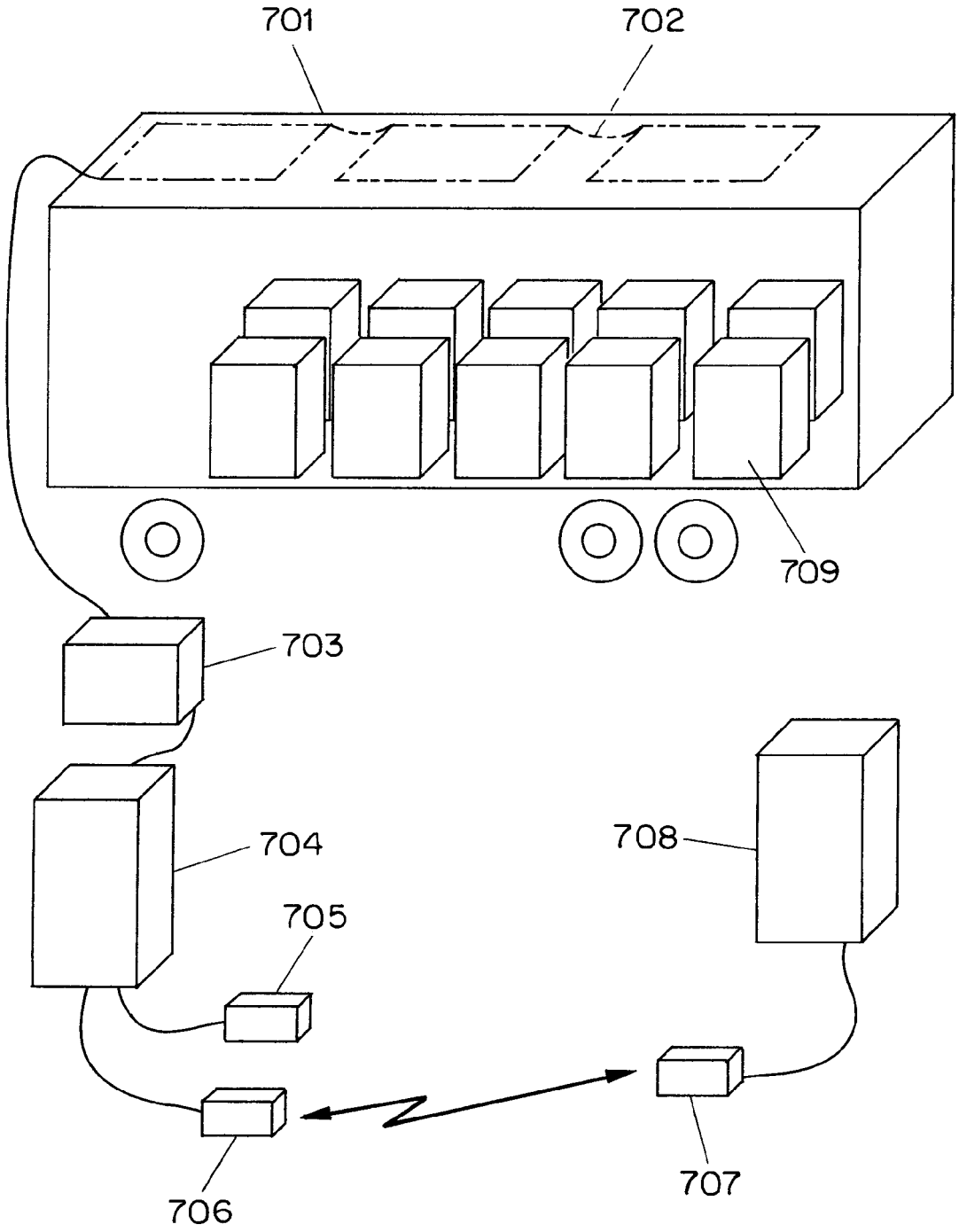
Figure 8:
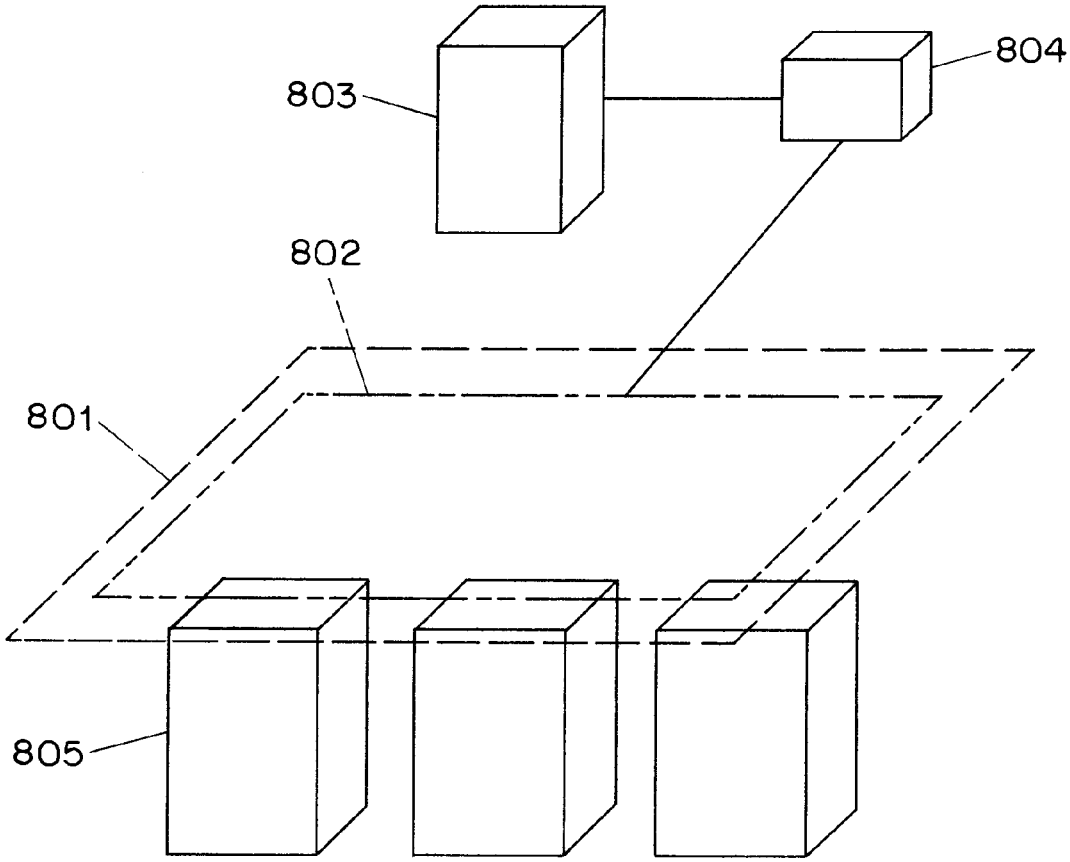
Figure 9:
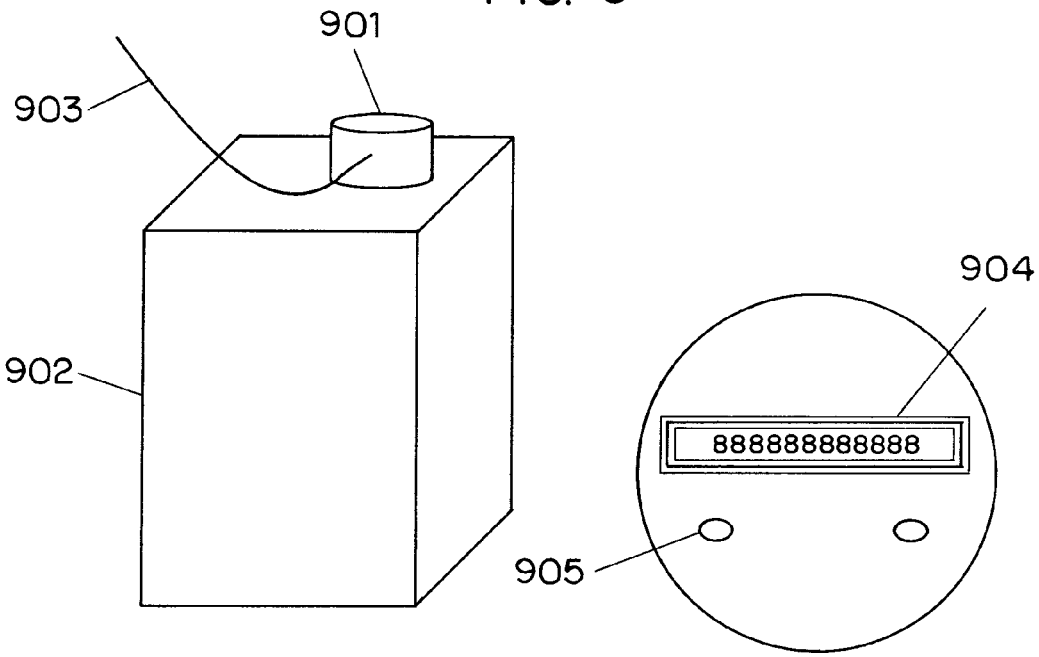
Figure 10:
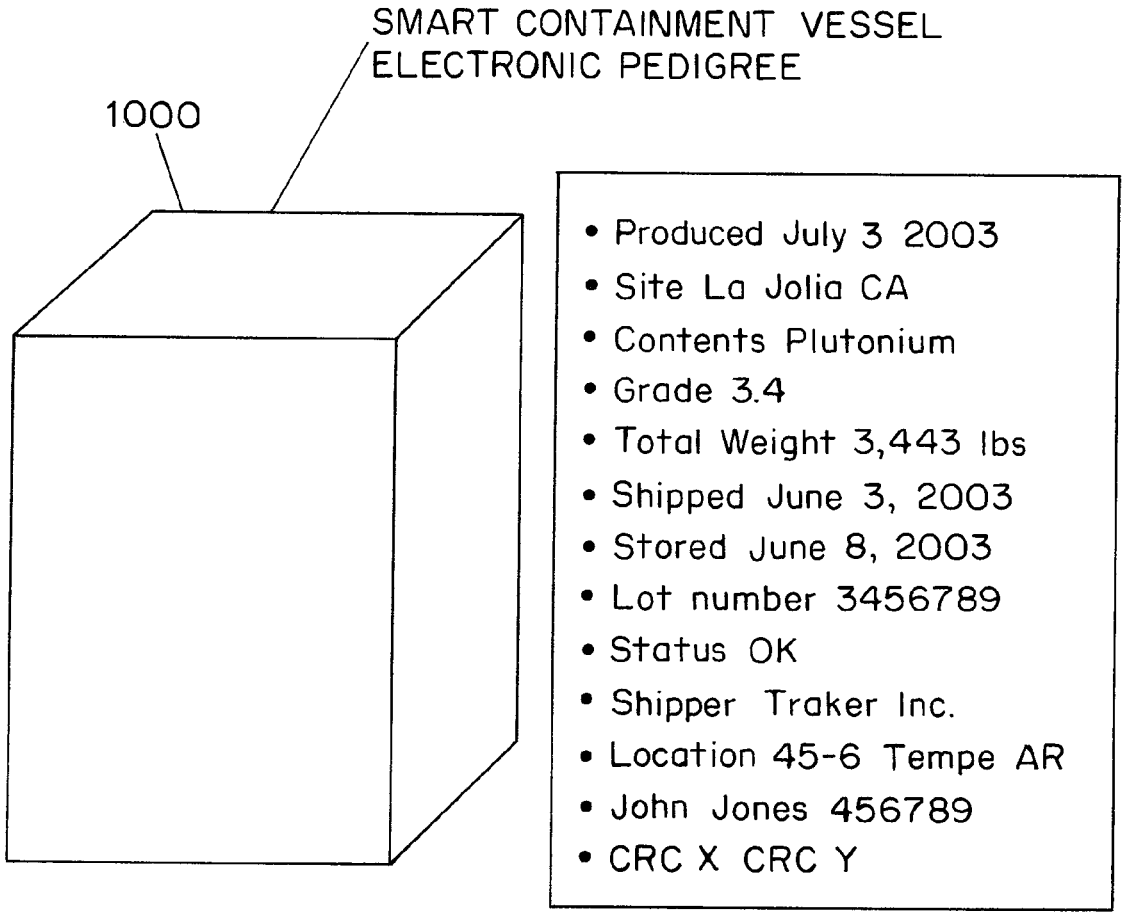

FIG. Four: Block diagram of the radio tag 411. The tag may have its own internal battery 401 to power a microprocessor 402, memory and e2 memory 403, a custom two-way RF modem chip 404 that drives the loop antenna 405. In addition, the tag may have several optional detectors to provide container status, including a humidity detector 406 to indicate that the core remains unhydrated. An optional angle detector 407 using mercury switches indicating the it is in an upright position, a temp detector 408, and an accelerometer, (Jog detector 409), to indicate that the vessel has not been dropped. An optional radiation detector may also be included as a sensor on the radio tag. A special power coil 410 may be added to the circuit to provide long-term power after the onboard battery 401 has died. The battery life of the onboard battery is maximum 35 years, and this backup system may be used to read and write information for up to 200 years or more after the battery dies. This tag coil 410 makes it possible to place a power pod coil on the outside of the smart containment vessel, making contact with the surface of the vessel, and providing power through an inductive link between the internal vessel coil 410 and a matched external coil. This power pod may be a standalone external device consisting of a battery and matching coil, (see FIG. 5), or it may be powered from a direct line that simply drives the coil.

FIG. Five: Block diagram of a stand alone external power pod 501. If the battery 401 contained in the radio tag 411 in the vessel fails or dies, (likely after 20-35 years), the power pod 501 may be used to supply power to the tag 411 without any direct contact. The power pod 501 is, in effect, an external battery pack that transfers power inductively through a matched coil to the radio tag 411. It consists of at least a single battery 502, a DC-to-AC converter circuit 503, and a matched coil 504 in a sealed pack. The battery 502, in some cases, may be replaced with a direct wired connection. A typical power pod may be able to supply power to a vessel for 5-10 years and can be buried underground with the vessel. Not shown in this block diagram is the option to also have a data link to the power pod. This may be used to drive LEDs and/or a LCD display on the power pod that could be used for picking and putting, as well as to provide information to individuals working with the container.

FIG. Six: The smart containment vessel 601 may be talked to and programmed using a handheld computer 602.

FIG. Seven: When radioactive waste is transported, it must be carefully tracked and security is critical, particularly when the waste is weapons-grade plutonium. The smart vessel system includes loop antennas, (item 702), placed on the top or bottom of the truck trailer, (item 701), in the same plane as the loop antenna in the radio tag. A base station, (item 703), can read and write to each smart vessel one at a time, and confirm that they are in place and okay on a periodic basis, (bed check every five minutes). This information can be transmitted to the server, (item 704), also on the truck. In addition, the server may have an optional GPS input, (item 705), and a modem 706 that communicates with a satellite system 707, (e.g., Orbicom), or via digital messaging using a cell phone. The status of the containment vessels maybe therefore be transmitted via this wireless link to a central server, (item 708), with date/time/GPS coordinates. This data may be written to a CD or other permanent media to create an archival audit trail of the pedigree. This same data may also be written to the tag as part of the smart containment vessel's Chain of Possession, (COP), and pedigree. The smart containment vessel may also transmit a signal to the base station on-demand if it detects something out of the ordinary, such as an alarm signal. This may be transmitted to the server, (item 708), for immediate action.

FIG. Eight: In many cases the smart containment vessels, (item 805), will be buried 5-10 feet underground, (see item 805 and the ground surface plane 801). After they are buried, it will be possible to monitor the smart containment vessels by placing a loop antenna, (item 802), on the surface of the ground. These loops, (item 802), can, in practice, be about 100 feet by 100 feet, (10,000 sq feet), and are controlled by a base station, (item 804), and server, (item 803). As the loops 802 become larger, the noise from external sources starts to reduce reliability. However, since the communication system is inductive between the loop 802 on the surface and the communications loop in the individual radio tags, it can freely pass through sand and dirt with minimal attenuation. Thus, the system can monitor the status and report to a central data location any changes in status. If a container, (item 805), detects it is being moved, it can send an on-demand signal to the base station, (item 804), and set off an alarm. If a container is moved outside of the loop 802, it can also serve as an alarm signal.

Figure 4:
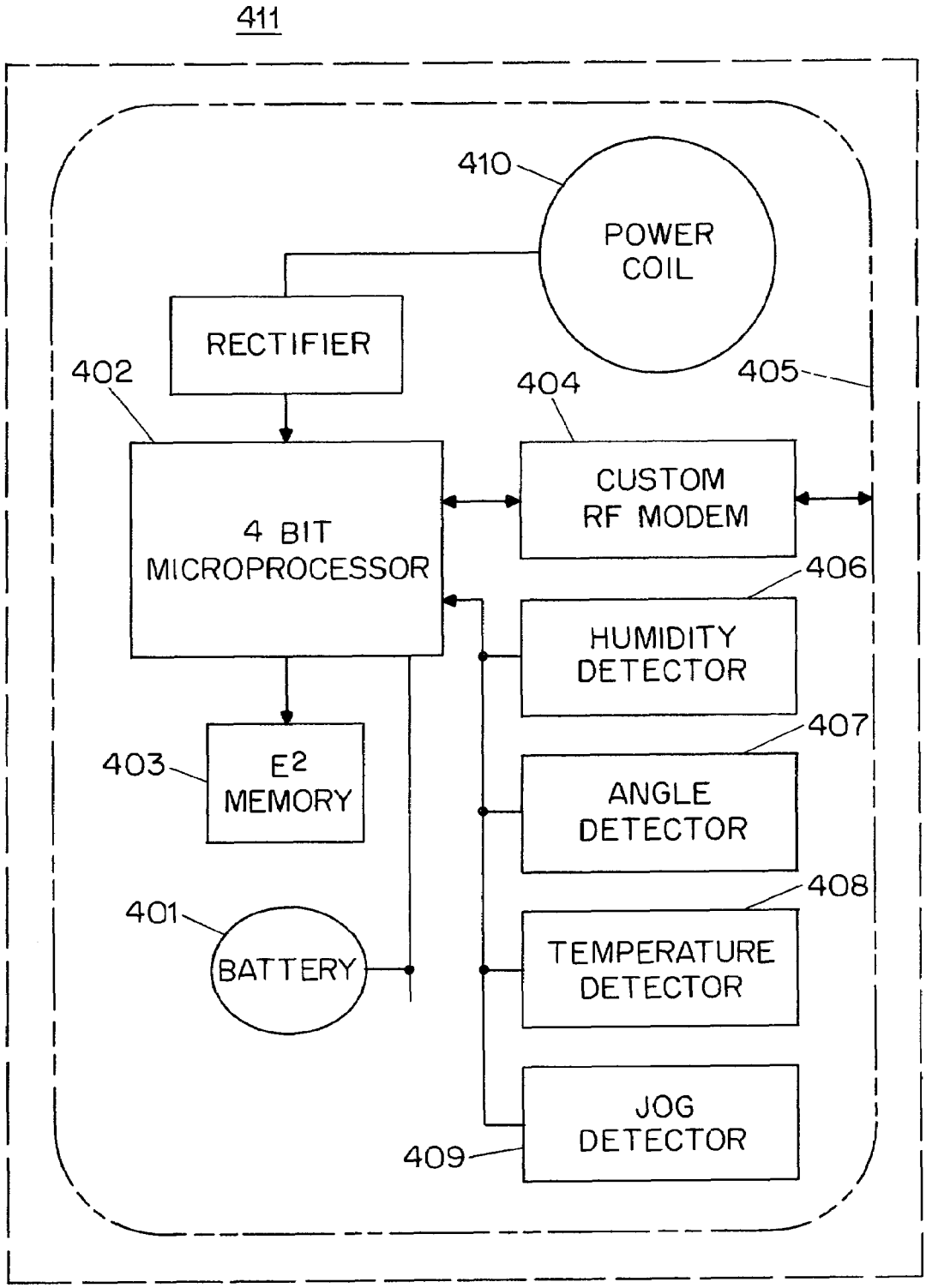

FIG. Nine: Detailed information regarding the transportation and history of the containment vessel may be required for 50 to 200 years. A typical Li battery has a proven life using low frequency communications systems as described here of about 15 years and that maybe extended to 20-35 years using large capacity military cells. It is likely that after a minimum of 15 years and maximum of 35 years, the on-board batteries will cease to function. A power pod, (item 901), described in FIGS. 1, 4, and 5, can be placed on the outside of the vessel to provide inductive power to the radio tag within the container, (item 902). These pods, (item 901), must be replaced once every 5 to 10 years to maintain functionality of the tags. A stand-alone pod may have its own battery, and optionally, once the units are buried, it may be less costly to place wired pods, (item 901), with wires, (item 903), that provide continuous inductive power to the smart containers, (item 902). These power pods, (item 901), may also have optional displays, (item 904), and LEDs, (item 905), for use in shipment and for picking and putting individual containers.

Figure 11:
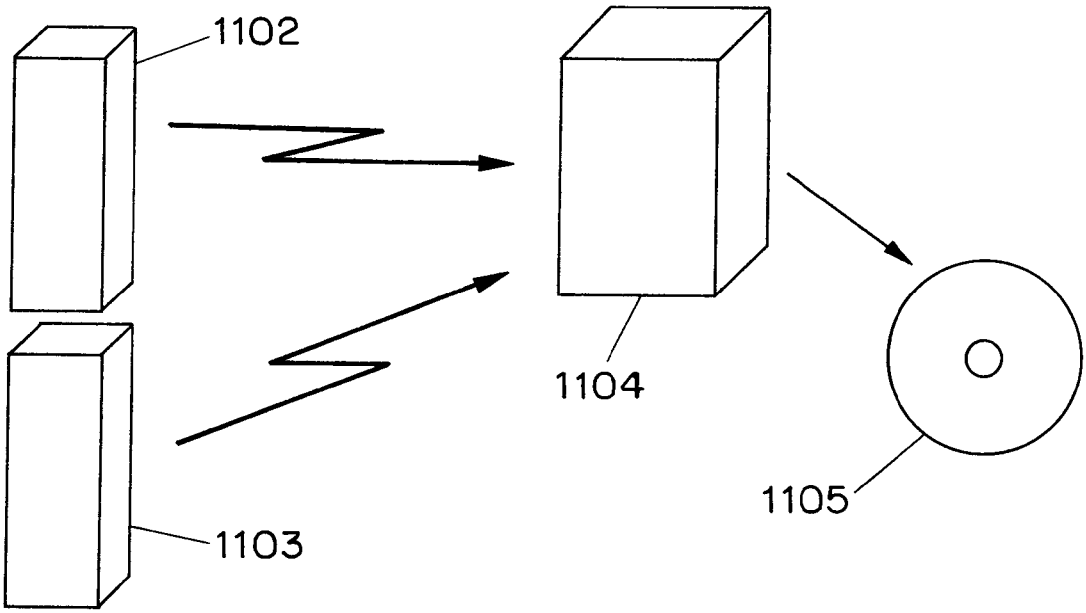

FIG. Ten: The radio tag will record and hold the vessel's full pedigree. The pedigree may also be stored in a database or on an auditable WOW CD, (see FIG. 11). However, the primary record will be in the radio tag. The tag may include digital signatures of responsible individuals throughout the life of the vessel, as well as a CRC X and CRC Y code so data errors may be detected and corrected. In most cases, two separate E2 memories will be used and each will be periodically rewritten to insure accuracy. A similar CRC and digital signatures may also be maintained in the audit trail.

FIG. Eleven: Since the radio tags within the containers, (items 1102 and 1103), may be read and written to wirelessly at low radio frequencies as it moves to its storage location, it is possible to create an independent audit trail, (item 1101), via a remote server, (item 1104), that writes to a write-once-only RO CD, (item 1105). This audit trail, (item 1101), may also include a date and time stamp along with the full status of the containers, (items 1102 and 1103).

While the present invention has been described with reference to preferred embodiments thereof, numerous obvious changes and variations may readily be made by persons skilled in the relevant arts. Accordingly, the invention should be understood to include all such variations to the full extent embraced by the claims.

What is claimed is:

1. A container for storing a hazardous waste item, said container comprising:

a) a RFID tag comprising an antenna, a transceiver operable at a low radio frequency not exceeding 15 MHz, a data storage device, a microprocessor operable to control data flow between said data storage device and said transceiver, and an energy source for providing energy to said transceiver, said data storage device, and said microprocessor;

b) an encasement structure surrounding said waste item and said RFID tag, said encasement structure comprising a cementitious composition.

2. A container as set forth in claim 1, wherein said radio frequency does not exceed 1 MHz.

3. A container as set forth in claim 1, wherein said data storage device is operable to store information selected from data for identifying said container, pedigree data about said container, and pedigree data about said waste item.

4. A container as set forth in claim 1, wherein said energy source comprises an energy storage device.

5. A container as set forth in claim 1, wherein said energy source comprises a tag coil operable for energization thereof as a result of inductive coupling of said tag coil to an external coil.

6. A container as set forth in claim 5, said energy source further comprising an energy storage device and an AC-to-DC converter, operable to charge said energy storage device from AC energy induced in said tag coil.

7. A container as set forth in claim 1, wherein said antenna comprises a loop antenna characterized by dimensions comparable to dimensions of said waste item.

8. A container as set forth in claim 1, wherein said waste item comprises a multigallon steel drum holding plutonium.

9. A container as set forth in claim 1, said RFID tag being encased in a protective shell before said disposing step c).

10. A container as set forth in claim 1, said RFID tag comprising a condition sensor operable to sense a condition experienced by said RFID tag, said condition sensor being operable for communication with said microprocessor for storage, in said data storage device, of data that defines said condition.

11. A container as set forth in claim 10, said container further comprising an indicator device operable to emit a signal at said low radio frequency upon a said condition beyond a selected threshold level.

12. A container for storing a dangerous waste item, said container comprising:

a) an inner layer surrounding said waste item, said inner layer comprising an unhydrated cementitious composition;

b) a RFID tag comprising an antenna, a transceiver operable at a low radio frequency not exceeding 15 MHz, a data storage device, a microprocessor operable to control data flow between said data storage device and said transceiver, and an energy source for providing energy to said transceiver, said data storage device, and said microprocessor;

c) an outer layer surrounding said inner layer and said RFID tag, said outer layer comprising a hydrated cementitious composition.

13. The container of claim 12, wherein the container is a steel drum holding plutonium or other nuclear waste.

14. A system for accessing information about a hazardous waste item during shipment and storage thereof, said system comprising:

i) a container for storing said hazardous waste item, said container comprising:

a) a RFID tag comprising an antenna, a transceiver operable at a low radio frequency not exceeding 15 MHz, a data storage device, a microprocessor operable to control data flow between said data storage device and said transceiver, and an energy source for providing energy to said transceiver, said data storage device, and said microprocessor;

b) an encasement structure surrounding said waste item and said RFID tag, said encasement structure comprising a cementitious composition; and ii) a field antenna operable to send an interrogation signal to said RFID tag at said low radio frequency and to receive data signals at said low frequency from said RFID tag.

15. A system as set forth in claim 14, said system further comprising a WOW, (write-once-only), data storage device, said WOW being in communication with said field and operable to store, in an unalterable manner, said data signals from said RFID tag.

16. A method for accessing information about a hazardous waste item during shipment and storage thereof, said method comprising: i) surrounding said waste item and an RFID tag in a container, said container comprising a cementitious composition, said RFID tag comprising a tag antenna, a transceiver operable at a low radio frequency not exceeding 15 MHz, a data storage device, a microprocessor operable to control data flow between said data storage device and said transceiver, and an energy source for providing energy to said transceiver, said data storage device, and said microprocessor; ii) disposing a field antenna in spaced adjacency to said container, iii) receiving data signals, (e.g., representing a condition experienced by said RFID tag), of said low radio frequency, at said field antenna and transmitting them to computing device; iv) storing information based upon said data signals; in a data storage apparatus.

17. A method as set forth in claim 16, said RFID tag comprising a condition sensor operable to sense a condition experienced by said RFID tag, said condition sensor being operable for communication with said microprocessor for storage, in said data storage device, of data that defines said condition, said receiving step iii) further comprising the steps of interrogating said RFID tag with a said low radio frequency interrogation signal to obtain said data signals representing said data that defines said condition.

18. A method as set forth in claim 16, further comprising the step of safeguarding said data storage apparatus.

19. A method of containing a hazardous waste item, said method comprising the steps of: a) disposing an inner layer of powdered hydraulic cement around a waste item; b) compressing said inner layer of powdered hydraulic cement around said waste item to form a compressed inner layer; c) disposing, adjacent said compressed inner layer, an RFID tag comprising an antenna, a transceiver operable at a low radio frequency not exceeding 15 MHz a data storage device, a microprocessor operable to control data flow between said data storage device and said transceiver, and an energy source for providing energy to said transceiver, said data storage device, and said microprocessor; d) positioning an outer layer of cement paste around said compressed inner layer of powdered hydraulic cement; and e) hydrating and curing the outer layer of cement paste without substantial hydration of said compressed inner layer of powdered hydraulic cement.

20. A method as set forth in claim 19, said RFID tag being encased in a protective shell before said disposing step c).

21. A method as set forth in claim 19, said disposing step c) further comprising a step of disposing a loop antenna adjacent said compressed inner layer, said loop antenna being operable for communication with said transceiver, said loop antenna having dimensions that are substantially comparable to said waste item; and said transceiver, data storage device, microprocessor, and energy source being encased in a protective shell.

22. The method of claim 19, wherein the transceiver is operable at a radio frequency of 128 KHz.

* * * * *